United States Patent [19]

Iser-Iser

[11] 3,979,132

[45] Sept. 7, 1976

[54] HEEL BINDING FOR CROSS COUNTRY SKIS

[76] Inventor: Herbert Iser-Iser, Teufelsbergstrasse 8, 8000 Munich 60, Germany

[22] Filed: Sept. 5, 1975

[21] Appl. No.: 610,744

[52] U.S. Cl. ..... 280/614; 280/632

[51] Int. Cl.[2] ..... A63C 11/12

[58] Field of Search ..... 280/11.35 E, 11.35 B, 280/11.35 A, 11.35 D, 11.35 C, 11.35 N, 11.35 T, 11.35 R, 11.35 W

[56] References Cited

UNITED STATES PATENTS

| | | | |
|---|---|---|---|
| 3,003,777 | 10/1961 | Hilding | 280/11.35 B |
| 3,877,712 | 4/1975 | Weckeiser | 280/11.35 E |

FOREIGN PATENTS OR APPLICATIONS

| | | | |
|---|---|---|---|
| 807,789 | 4/1951 | Germany | 280/11.35 T |
| 543,149 | 5/1956 | Italy | 280/11.35 E |
| 141,352 | 6/1930 | Switzerland | 280/11.35 B |

*Primary Examiner*—M. H. Wood, Jr.
*Assistant Examiner*—David M. Mitchell
*Attorney, Agent, or Firm*—Oblon, Fisher, Spivak, McClelland & Maier

[57] ABSTRACT

According to the invention a heel binding is envisaged which gives the possibility of a positive contact between the heel of the shoe and the cross country ski within the natural limits of the elasticity of the components being used. According to this invention this function is resolved by two parallel, swivel mounted stirrups, one of which serves as a tensioning stirrup and the other as an operating stirrup. Through the swivelling of the same it is possible to engage or release the binding.

10 Claims, 4 Drawing Figures

HEEL BINDING FOR CROSS COUNTRY SKIS

The invention appertains to a heel binding for cross country skis.

Generally cross country skis are used without a heal binding, as the heal of the ski shoe has to be free to move up and down when cross country skiing. Due to this the cross country skier becomes very insecure when negotiating down hill slopes, as no firm contact between the heel of the ski shoe and the ski is possible due to the lack of a heel binding. This lack of a heel binding makes the swinging of the skis practically impossible. The heal binding according to the German Utility Model 72 20 989 serves to increase the lateral stability of the shoe on the ski. This already known heel binding consists of an open element to receive the ski shoe which is firmly secured to the cross country ski and a wedge shaped element which is screwed to the ski shoe. The latter wedge shaped element can be placed in the correspondingly shaped element on the ski. This increases the lateral stability of the shoe relative to the ski when the heel of the shoe is in direct contact or slightly raised from the ski. It is not possible however to swing the skis satisfactorily with this binding as the heel of the ski shoe can move vertically in relation to the ski. The object of this invention is to so contrive a heel binding for a cross country ski which enables the satisfactory swinging of the ski on down hill slopes and above this to be simple in construction and usage.

According to this invention this function is resolved by two parallel, swivel mounted stirrups, one of which serves as a tensioning stirrup and the other as an operating stirrup. Through the swivelling of the same it is possible to engage or release the binding.

According to the invention a heel binding is envisaged which gives the possibility of a positive contact between the heel of the shoe and the cross country ski within the natural limits of the elasticity of the components being used. The binding may be opened or closed by the sole operation of the operating stirrup in such a fashion as not to hinder the forward motion of the skier. The heel binding according to this invention gives a maximum possible security when negotiating down hill slopes, the limits of security being the characteristics of the cross country ski rather than the contact between shoeheel and ski effected by the binding.

The invention is described in the following pages taking into account the various possible versions which are described in detail with the aid of sketches FIG. 1 shows the heel binding according to the invention in the shut position on the cross country ski shoe or boot portrayed in perspective.

Figure 1:
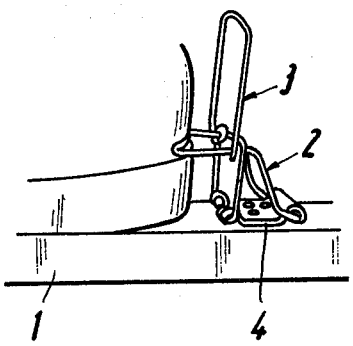

As the illustrations clearly show the heel binding consists of two swivelling stirrups 2 and 3 which are mounted on the ski 1. The stirrup 3 serves as the operating stirrup through the swivelling motion of which the same serves to guide the tensioning stirrup. The mounting of the two stirrups 2 and 3 on the ski is effected by a mounting plate 4 on the forward rearward edge of which bearing cups 5 and 6 of semi-circular shape are formed. These two bearing cups 5 and 6 accept the four ends of the stirrups 2 and 3 in such a manner that two axes parallel to the upper surface and perpendicular to the longitudinal axis of the ski for the two stirrups 2 and 3 are formed. The mounting plate has elongated holes and is secured to the cross country ski by means of screws 7. In order to fit the heel of the cross country skiing shoe into the heel binding a spacer 8 can be fitted between the cross country ski 1 and the mounting plate 4. The front bearing cup 5 for the stirrup 3 in the mounting plate 4 is formed in two parts, in order that the two center pointing ends 9 and 10 of the operating stirrup 3 may be bent in such a manner as to prevent them from slipping out of the bearing cup 5.

The operating stirrup is substantially rectangular in shape whereby on the side arms 3' and 3'' eyes or loops 10' are bent or otherwise formed so as to accept the side arms 2' and 2'' of the tensioning stirrup 2 in such a manner that when the operating stirrup is swivelled the tensioning stirrup is forced to swivel. The two stirrups 2 and 3 cross each other so that the force which is brought to bear on the operating stirrup transmitted directly onto tensioning stirrup. The position of the operating stirrup directly influences the position of the tensioning stirrup.

The tensioning stirrup has a bowed section 2''' which is so bowed as to accept the heel of the cross country ski shoe and joins the two side arms 2' and 2''. When the binding is in the closed position this bowed section holds the heel of the cross country skiing shoe either in a groove in the heel of the shoe or just above the heel as shown in FIG. 1. Furthermore the side arms 2' and 2'' of the tensioning stirrup 2 are so bent that a knee 11 is formed. It is clearly shown in FIG. 3 that the operating stirrup, shown dotted in FIG. 3 has to overcome the knee 11 in order to reach the locked position, which is drawn in full in FIG. 3. The tensioning stirrup which is already in contact with the heel of the ski shoe hardly moves during this operation. The knee 11 therefore produces the maximum tensioning of tensioning stirrup through the operating stirrup in such a manner that after the operating stirrup has overcome the knee 11 it snaps into the closed position and is securely held in this position. This snap action is reinforced in that the two side arms 2' and 2'' of the tensioning stirrup 2 are a minimal distance apart in the position where the operating lever is closed and correspond to the distance between the loops 10' of the operating stirrup 3. This can be seen in FIG. 4 that the side arms 2' and 2'' of the tensioning stirrup 2 are at a minimum in this position, that is where the operating stirrup is in the closed position. Before reaching the closed position the operating stirrup is forced apart so as to be elastically deformed. This is made possible by the bent up ends 9 and 10.

Figure 2:
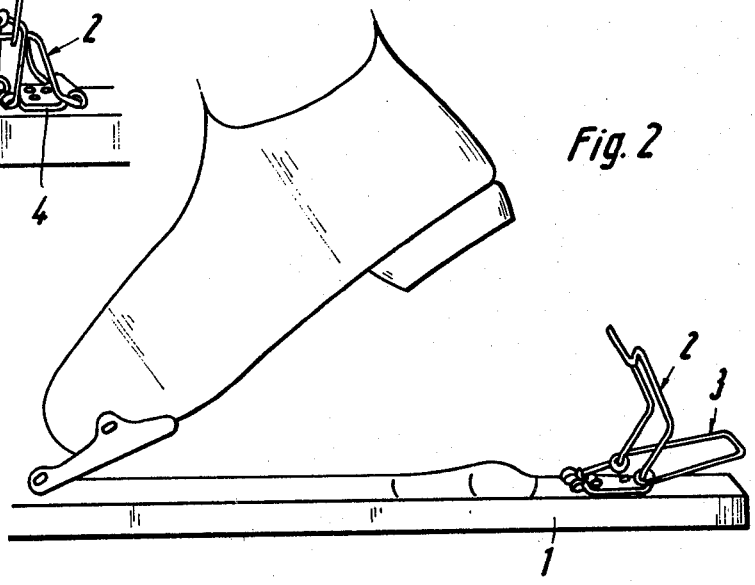
FIG. 2 shows the heel binding as in FIG. 1 but in the open position with the heel of the shoe raised.
Figure 3:
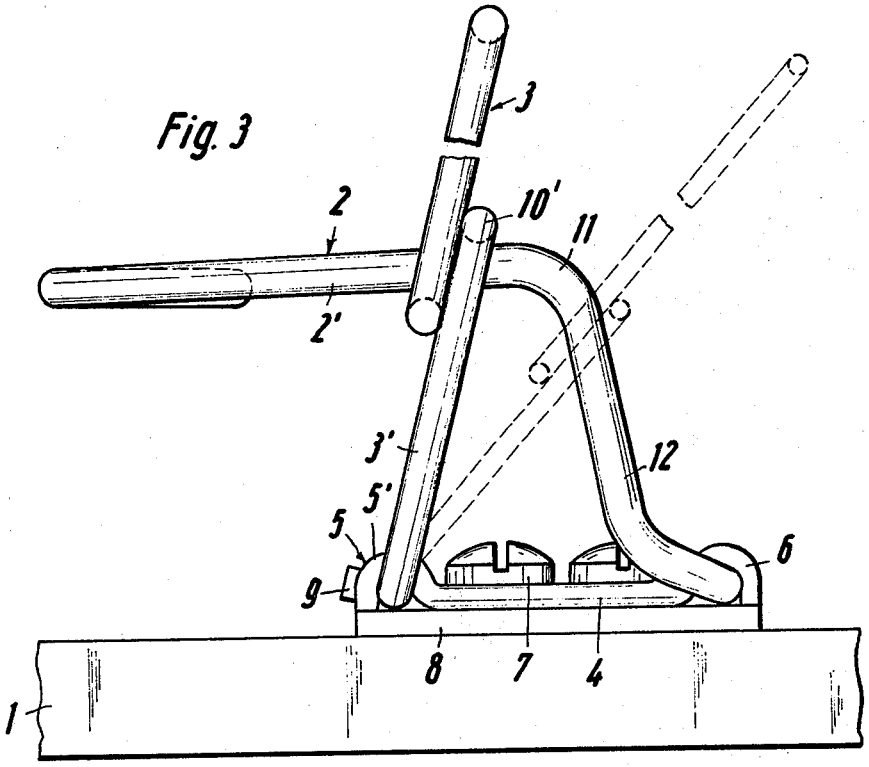
FIG. 3 shows the heel binding according to the invention in side view without shoe and FIG. 4 shows the plan view of the binding as in FIG. 3
Figure 4:
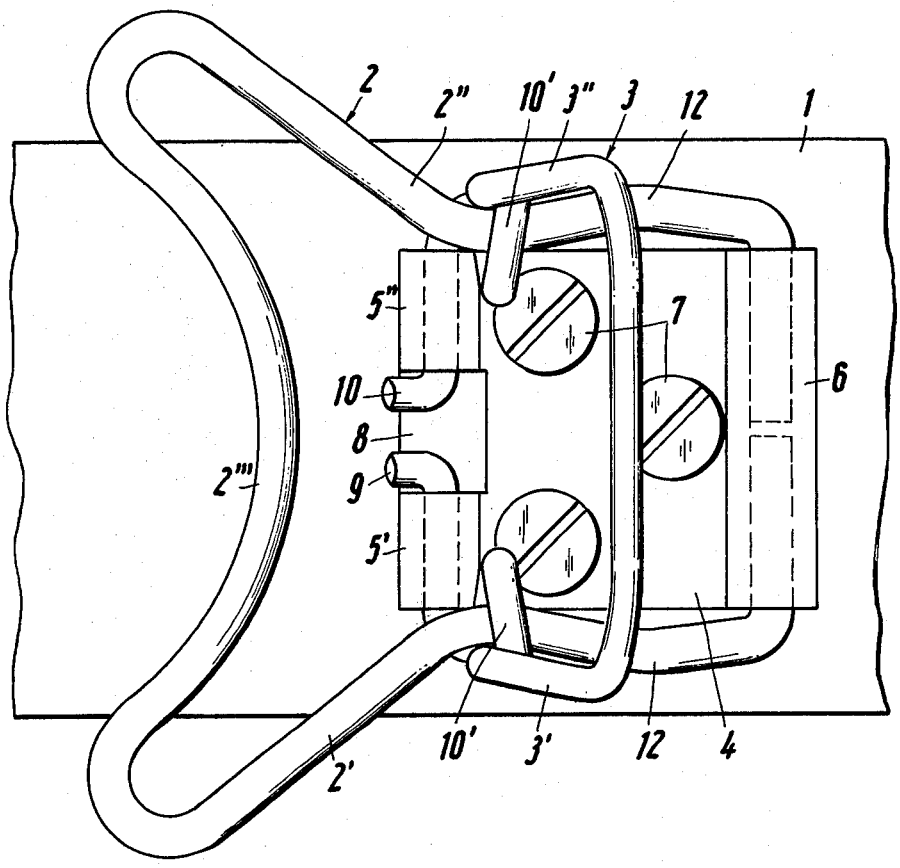

FIG. 4 shows further, that the side arms 2' and 2'' of the tensioning stirrup have a bent out knee 12 in the proximity of the swivel bearing, so that the operating stirrup 3 is forced to overcome this knee 12 when it is moved into the open position shown in FIG. 2 after being moved out of the closed position in FIG. 3 As the stirrup is forced apart when overcoming this knee 12 and that the tension is then released in the open position shown in FIG. 2, a snap effect is achieved so that both stirrups are positively held in the open position in such a manner as not to hinder the free movement of the heel of the cross country ski shoe.

The most advantageous material from which the stirrups can be manufactured is spring steel wire, they may however be manufactured from steel sheet on plastic.

I claim:

1. A heel binding for a cross-country ski comprising:

two swivel mounted stirrups (2,3) each pivotally mounted about an axis transverse to said ski and arranged parallel and some distance apart, one (2) of said stirrups being a tensioning stirrup which is guided and operated by means of the other stirrup (3) such that by swivelling said operating stirrup for closing or opening said binding, said tensioning stirrup may be brought into positive contact with the heel of the cross-country ski shoe, or released;

said operating stirrup being mounted in front of said tensioning stirrup in the direction of travel of said ski; and eye-type guide means (10') fixed to the sides (3', 3'') of said operating stirrup and operatively engaging the sides (2', 2'') of said tensioning stirrup so as to guide and operate said tensioning stirrup.

2. Heel binding according to claim 1 having guiding elements (10') so positioned on the operating stirrup (3) that the tensioning stirrup releases (2) the heel of the cross country ski boot when the operating stirrup has reached the fully open position.

3. Heel binding according to claim 1 having two stirrups (2,3) which are mounted in a plate (4) which is adjustably mounted on the cross country ski (1) by means of a spacer (8).

4. Heel binding according to claim 3, having the ends (9,10) of the operating stirrup (3) so mounted in the mounting plate (4) that they may not be withdrawn even when the operating stirrup (3) operates said tensioning stirrup.

5. Heel binding according to claim 1 having a tensioning stirrup 2 with side arms 2' and 2'' joined by a bowed section 2''' so formed to accept the heel of the cross country ski.

6. Heel binding according to claim 1 having side arms (2' and 2'') of the tensioning stirrup (2) which have a knee 11 which is so bent that the operating stirrup (3) has to overcome the knee (11) with the eye (10') before it snaps into the closed position.

7. Heel binding according to claim 1 having side arms (2' and 2'') of the tensioning stirrup (2) which are bent into an outward facing knee (12) in such a manner that when the operating lever (3) is opened it snaps into the open position.

8. Heel binding according to claim 1 having two one piece stirrups (2,3) manufactured from spring steel wire.

9. Heel binding according to claim 1 having stirrups (2 and 3) manufactured from steel sheet.

10. Heel binding according to claim 1 having two stirrups (2 and 3) manufactured from plastic.

* * * * *